US010280385B2

(12) United States Patent
Nakajima et al.

(10) Patent No.: US 10,280,385 B2
(45) Date of Patent: May 7, 2019

(54) DETERGENT COMPOSITION FOR HARD SURFACES

(71) Applicant: NICCA CHEMICAL CO., LTD., Fukui-shi, Fukui (JP)

(72) Inventors: Junichi Nakajima, Fukui (JP); Masahiko Shimakawa, Fukui (JP); Fumitaka Ito, Fukui (JP)

(73) Assignee: Nicca Chemical Co., Ltd., Fukui-shi, Fukui (JP)

( * ) Notice: Subject to any disclaimer, the term of this patent is extended or adjusted under 35 U.S.C. 154(b) by 68 days.

(21) Appl. No.: 15/691,185

(22) Filed: Aug. 30, 2017

(65) Prior Publication Data

US 2017/0362544 A1 Dec. 21, 2017

Related U.S. Application Data

(63) Continuation-in-part of application No. PCT/JP2016/056092, filed on Feb. 29, 2016.

(30) Foreign Application Priority Data

Mar. 5, 2015 (JP) ..... 2015-043562

(51) Int. Cl.

| | |
|---|---|
| ***C11D 3/37*** | (2006.01) |
| ***C11D 3/00*** | (2006.01) |
| ***C11D 1/04*** | (2006.01) |
| ***C11D 7/26*** | (2006.01) |
| ***C11D 7/32*** | (2006.01) |
| ***C11D 1/83*** | (2006.01) |
| ***C11D 3/20*** | (2006.01) |
| ***C11D 11/00*** | (2006.01) |
| *C11D 1/722* | (2006.01) |

(52) U.S. Cl.

CPC ..... *C11D 3/0026* (2013.01); *C11D 1/04* (2013.01); *C11D 1/8305* (2013.01); *C11D 3/2075* (2013.01); *C11D 3/3707* (2013.01); *C11D 7/261* (2013.01); *C11D 7/263* (2013.01); *C11D 7/265* (2013.01); *C11D 7/3218* (2013.01); *C11D 11/0023* (2013.01); *C11D 1/722* (2013.01)

(58) Field of Classification Search

CPC ..... C11D 3/3757
USPC ..... 510/475
See application file for complete search history.

(56) References Cited

U.S. PATENT DOCUMENTS

| | | | | |
|---|---|---|---|---|
| 6,680,286 | B1 * | 1/2004 | Kawaguchi | C11D 1/72 510/276 |
| 2005/0101513 | A1 * | 5/2005 | Yoneda | C08F 290/06 510/475 |
| 2007/0167343 | A1 * | 7/2007 | Suzuki | C11D 1/04 510/329 |
| 2009/0197793 | A1 * | 8/2009 | Inoue | C11D 1/662 510/433 |
| 2011/0245133 | A1 * | 10/2011 | Dupont | C08F 290/062 510/357 |
| 2018/0237727 | A1 * | 8/2018 | Nakajima | C11D 3/30 |

FOREIGN PATENT DOCUMENTS

| | | | |
|---|---|---|---|
| CN | 102753669 | A | 10/2012 |
| CN | 103221528 | A | 7/2013 |
| CN | 103975048 | A | 8/2014 |
| JP | 2002-509186 | A | 3/2002 |
| JP | 2009-084621 | A | 4/2009 |
| JP | 2009-144070 | A | 7/2009 |
| JP | 2010-077342 | A | 4/2010 |
| JP | 2011-132381 | A | 7/2011 |
| JP | 2011-168640 | A | 9/2011 |
| JP | 2013-213266 | A | 10/2013 |
| JP | 2014-005456 | A | 1/2014 |
| JP | WO 2016/056092 | A1 | 5/2016 |
| WO | WO 99/036499 | A1 | 7/1999 |

OTHER PUBLICATIONS

International Bureau, International Preliminary Report on Patentability in counterpart International Application No. PCT/JP2016/056092, dated Sep. 14, 2017.
Japan Patent Office, International Search Report in International Application No. PCT/JP2016/056092, dated May 17, 2016.
Chinese Patent Office, Office Action in counterpart Chinese Application No. 201680004138.6, dated Jan. 3, 2019.

* cited by examiner

*Primary Examiner* — Gregory E Webb
(74) *Attorney, Agent, or Firm* — Leydig Voit & Mayer

(57) ABSTRACT

The cleaning agent composition for hard surface contains at least one kind of carboxylic acid compound selected from the group consisting of an aliphatic monocarboxylic acid, a polycarboxylic acid, and any neutralized salt of these, a specific first alkyleneoxy group-containing compound, a specific second alkyleneoxy group-containing compound, and a specific oxypropylene group-containing compound.

2 Claims, No Drawings

DETERGENT COMPOSITION FOR HARD SURFACES

CROSS-REFERENCE TO RELATED APPLICATIONS

This patent application is the U.S. Continuation in part of International Application No. PCT/JP2016/056092, filed Feb. 29, 2016, which claims the benefit of Japanese Application No. 2015-043562, filed Mar. 5, 2015, which are each incorporated by reference.

TECHNICAL FIELD

The present invention relates to a cleaning agent composition to be used for cleaning a hard surface.

BACKGROUND ART

In recent years, domestic parts makers are exposed to intense cost competition as parts markets of automobiles, trains, airplanes, machine tools, and the like have been globalized and low-priced parts have been introduced into the markets. For these reasons, each parts manufacturer has taken various cost saving measures in the materials and manufacturing process in order to maintain the competitive power.

As one example of cost saving measures in the manufacturing process, the temperature for the cleaning step has been lowered to normal temperature. By performing parts cleaning which has been performed at a relatively high temperature at normal temperature, the cleaning bath is not required to be heated and the energy cost saving is thus expected, but there is a problem that the performance to be originally required to the cleaning step such as detergency and defoaming property deteriorates.

When the amount of cleaning agent is increased in order to compensate for the detergency, not only the cost saving itself is not achieved as the cost of chemicals increases but also a number of troubles in the process occur so that bubbles generated in the cleaning bath by an increase in the amount of chemicals used overflow from the bathtub.

It has been hitherto investigated to improve the cleaning performance and foam inhibiting property of cleaning agent. For example, the following Patent Literature 1 below discloses a metal cleaning agent composition containing two specific kinds of nonionic surfactant. In addition, the following Patent Literature 2 below discloses a metal cleaning agent containing a specific ionic surfactant, a specific amine compound, an aminocarboxylic acid-based chelating agent, and a carboxylic acid in combination.

CITATION LIST

Patent Literature

Patent Literature 1: Japanese Unexamined Patent Publication No. 2009-84621

Patent Literature 2: Japanese Unexamined Patent Publication No. 2011-132381

SUMMARY OF INVENTION

Technical Problem

However, the detergency at room temperature (25° C.) has not been sufficient even in the case of the cleaning agents described in Patent Literatures above. In addition, bubbles tend to be easily generated and to hardly disappear in the case of performing the cleaning at room temperature as compared to the case performing the cleaning at a high temperature such as 60° C.

The present invention has been made in view of the above circumstances, and an object thereof is to provide a cleaning agent composition for hard surface which can obtain sufficient detergency while sufficiently suppressing the generation of bubbles even at room temperature.

Solution to Problem

In order to solve the above problems, the present invention provides a cleaning agent composition for hard surface containing (A) at least one kind of carboxylic acid compound selected from the group consisting of an aliphatic monocarboxylic acid, a polycarboxylic acid, and any neutralized salt of these, (B) a compound represented by the following General Formula (B-1), (C) a compound represented by the following General Formula (C), and (D) a compound represented by the following General Formula (D).

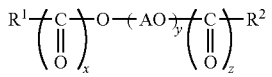

(B-1)

[In Formula (B-1), $R^1$ represents an alkyl group which has from 8 to 30 carbon atoms and may have a hydroxyl group, an alkenyl group which has from 8 to 30 carbon atoms and may have a hydroxyl group, or a group represented by the following General Formula (B-2), $R^2$ represents a hydrogen atom, an alkyl group which has from 1 to 30 carbon atoms and may have a hydroxyl group, or an alkenyl group which has from 2 to 30 carbon atoms and may have a hydroxyl group, x and z are each independently 0 or 1, AO represents an alkyleneoxy group having from 2 to 4 carbon atoms, and y represents an average molar number of the alkyleneoxy group added and is in a range of from 11 to 200. However, $R^2$ is a hydrogen atom and x and z are 0 when $R^1$ is a group represented by the following General Formula (B-2).

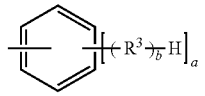

(B-2)

{in Formula (B-2), $R^3$ represents a divalent group represented by the following Formula (B-3), a is an integer from 1 to 5, b is an integer from 1 to 5, a total number of a×b is in a range of from 1 to 5, a plurality of b's may be the same as or different from one another when a in Formula (B-2) is 2 or greater.

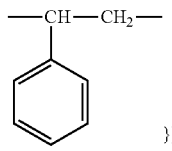

(B-3)

}]

-continued $$R^4—O—(AO)_p—H \quad (C)$$

[In Formula (C), $R^4$ represents an alkyl group having from 1 to 8 carbon atoms or an alkenyl group having from 2 to 8 carbon atoms, AO represents an alkyleneoxy group having from 2 to 4 carbon atoms, p represents an average molar number of the alkyleneoxy group added and is in a range of from 1 to 5.]

$$HO—(EO)_s—(PO)_t—(EO)_u—H \quad (D)$$

[In Formula (D), EO represents an oxyethylene group, PO represents an oxypropylene group, s and u represent an average molar number of the oxyethylene group added, s+u is in a range of from 0 to 10, and t represents an average molar number of the oxypropylene group added and is in a range of from 1 to 100.]

According to the cleaning agent composition for hard surface of the present invention, it is possible to obtain sufficient detergency while sufficiently suppressing the generation of bubbles even at room temperature as it has the configuration described above.

In the cleaning agent composition for hard surface of the present invention, it is preferable that the content of the carboxylic acid compound is from 1% by mass to 40% by mass, the content of the compound represented by General Formula (B-1) above is from 0.01% by mass to 0.5% by mass, the content of the compound represented by General Formula (C) above is from 0.1% by mass to 15% by mass, and the content of the compound represented by General Formula (D) above is from 0.01% by mass to 5% by mass based on the entire amount of the cleaning agent composition for hard surface.

Advantageous Effects of Invention

According to the present invention, it is possible to provide a cleaning agent composition for hard surface which can obtain sufficient detergency while sufficiently suppressing the generation of bubbles even at room temperature.

DESCRIPTION OF EMBODIMENTS

The cleaning agent composition for hard surface of the present embodiment contains (A) at least one kind of carboxylic acid compound selected from the group consisting of an aliphatic monocarboxylic acid, a polycarboxylic acid, and any neutralized salt of these, (B) a specific first alkyleneoxy group-containing compound, (C) a specific second alkyleneoxy group-containing compound, and (D) a specific oxypropylene group-containing compound.

According to the cleaning agent composition for hard surface of the present embodiment, it is possible to obtain sufficient detergency while sufficiently suppressing the generation of bubbles even at room temperature. This makes it possible to expect energy cost saving as the cleaning step which has been hitherto performed at a high temperature is performed at normal temperature and the cleaning bath is thus not required to be heated.

Examples of the aliphatic monocarboxylic acid to be used as the component (A) may include a straight-chain or branched-chain unsaturated or saturated aliphatic monocarboxylic acid which may have a hydroxyl group and has from 6 to 24 carbon atoms. Specific examples of such an aliphatic monocarboxylic acid may include caproic acid, caprylic acid, enantoic acid, pelargonic acid, capric acid, lauric acid, myristic acid, palmitic acid, palmitoleic acid, margaric acid, stearic acid, oleic acid, vaccenic acid, linoleic acid, (9,12,15)-linolenic acid, (6,9,12)-linolenic acid, eleostearic acid, arachidic acid, (8,11)-eicosadienoic acid, (5,8,11)-eicosatrienoic acid, arachidonic acid, behenic acid, lignoceric acid, nervonic acid, 2-ethylhexanoic acid, 2-methylhexanoic acid, 2-methylheptanoic acid, trimethylhexanoic acid, isostearic acid, and 12-hydroxystearic acid. These may be used singly or in combination of two or more kinds thereof.

Examples of any neutralized salt of the aliphatic monocarboxylic acid to be used as the component (A) may include neutralized salts obtained by neutralizing the aliphatic monocarboxylic acids described above with an alkali metal, an amine-based compound, and the like. Here, examples of the alkali metal may include sodium, potassium, and lithium, and examples of the amine-based compound may include ammonia, monoethanolamine, diethanolamine, and triethanolamine. These may be used singly or in combination of two or more kinds thereof.

From the viewpoint of cleaning performance, the aliphatic monocarboxylic acid and any neutralized salt thereof to be used as the component (A) are preferably a straight-chain or branched-chain unsaturated or saturated aliphatic monocarboxylic acid having from 6 to 18 carbon atoms and any neutralized salt thereof and more preferably a straight-chain or branched-chain unsaturated or saturated aliphatic monocarboxylic acid having from 6 to 12 carbon atoms and any neutralized salt thereof. These may be used singly or in combination of two or more kinds thereof.

Examples of the polycarboxylic acid to be used as the component (A) may include a polycarboxylic acid having a weight average molecular weight of from 500 to 150,000. From the viewpoint of cleaning performance and handling property, a polycarboxylic acid having a weight average molecular weight of from 1,000 to 100,000 is preferable and a polycarboxylic acid having a weight average molecular weight of from 1,000 to 50,000 is more preferable. In the present specification, the weight average molecular weight of the polycarboxylic acid means a value to be measured by gel permeation chromatography (GPC).

Examples of the polycarboxylic acid may include homopolymers and copolymers synthesized by employing a conventionally known radical polymerization method using a vinyl monomer having a carboxyl group such as acrylic acid, methacrylic acid, maleic acid, fumaric acid, or itaconic acid. As the polycarboxylic acid, commercially available ones may be used. In the radical polymerization, a copolymerizable monomer which does not have a carboxyl group may be used in addition to the monomer described above in a range in which the effect of the present invention is not impaired. Examples of such a monomer may include a vinyl monomer such as ethylene, vinyl chloride, or vinyl acetate, acrylamide, an acrylate, and a methacrylate. As the acrylate and methacrylate, those having an alkyl group having from 1 to 3 carbon atoms or an alkenyl group having from 2 to 3 carbon atoms are preferable. These alkyl groups or alkenyl groups may have a substituent such as a hydroxyl group. Examples of such acrylates and methacrylates may include methyl acrylate, methyl methacrylate, ethyl acrylate, ethyl methacrylate, 2-hydroxyethyl acrylate, 2-hydroxyethyl methacrylate, propyl acrylate, and propyl methacrylate. The weight ratio of the vinyl monomer having a carboxyl group to the copolymerizable monomer which does not have a carboxyl group is preferably from 100:0 to 50:50, more preferably from 100:0 to 70:30, and still more preferably from 100:0 to 90:10 from the viewpoint of cleaning performance. These copolymerizable monomers may be used singly or in combination of two or more kinds thereof.

Examples of any neutralized salt of the polycarboxylic acid to be used as the component (A) may include neutralized salts obtained by neutralizing the polycarboxylic acids described above with an alkali metal, an amine-based compound, and the like. Here, examples of the alkali metal may include sodium, potassium, and lithium, and examples of the amine-based compound may include ammonia, monoethanolamine, diethanolamine, and triethanolamine. These may be used singly or in combination of two or more kinds thereof.

The method of manufacturing the polycarboxylic acid and any neutralized salt thereof is not particularly limited, but examples thereof may include a method in which a radical polymerization initiator is added the monomer described above and/or to an aqueous solution of any salt thereof and the mixture is heated and reacted at from 30° C. to 150° C. for from 2 to 5 hours. At this time, an aqueous solvent such as an alcohol such as methanol, ethanol, or isopropyl alcohol or acetone may be added to the monomer and/or the aqueous solution of any salt thereof. The radical polymerization initiator to be used is also not particularly limited, but examples thereof may include a persulfate such as potassium persulfate, sodium persulfate, or ammonium persulfate, a redox system polymerization initiator by the combination of a persulfate with sodium bisulfite and the like, hydrogen peroxide, and water-soluble azo-based polymerization initiator. These radical polymerization initiators may be used singly or in combination of two or more kinds thereof. At the time of radical polymerization, a chain transfer agent (for example, octyl thioglycolate) may be added for the purpose of adjusting the degree of polymerization.

As the polycarboxylic acid and any neutralized salt thereof to be used as the component (A), a homopolymer of acrylic acid, methacrylic acid, or maleic acid or any neutralized salt thereof or a copolymer containing any one or more kinds of acrylic acid, methacrylic acid, or maleic acid as a monomer component or any neutralized salt thereof is preferable and a homopolymer of acrylic acid or any neutralized salt thereof is more preferable from the viewpoint of cleaning performance. The polycarboxylic acids described above and neutralized salts thereof may be used singly or in combination of two or more kinds thereof.

The amount of the component (A) blended in the cleaning agent composition for hard surface is appropriately set depending on the purpose of use, but it is preferably from 1% by mass to 40% by mass and more preferably from 1% by mass to 20% by mass based on the entire amount of the cleaning agent composition for hard surface from the viewpoint of cleaning performance, rust preventing property, and economic efficiency.

Next, the specific first alkyleneoxy group-containing compound (B) according to the present embodiment will be described. Examples of the compound may include a compound represented by the following General Formula (B-1).

(B-1)

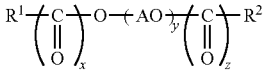

[In Formula (B-1), $R^1$ represents an alkyl group which has from 8 to 30 carbon atoms and may have a hydroxyl group, an alkenyl group which has from 8 to 30 carbon atoms and may have a hydroxyl group, or a group represented by the following General Formula (B-2), $R^2$ represents a hydrogen atom, an alkyl group which has from 1 to 30 carbon atoms and may have a hydroxyl group, or an alkenyl group which has from 2 to 30 carbon atoms and may have a hydroxyl group, x and z are each independently 0 or 1, AO represents an alkyleneoxy group having from 2 to 4 carbon atoms, and y represents an average molar number of the alkyleneoxy group added and is in a range of from 11 to 200. However, $R^2$ is a hydrogen atom and x and z are 0 in a case in which $R^1$ is a group represented by the following General Formula (B-2).

(B-2)

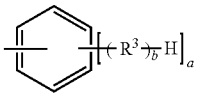

{in Formula (B-2), $R^3$ represents a divalent group represented by the following Formula (B-3), a is an integer from 1 to 5, b is an integer from 1 to 5, a total number of a×b is in a range of from 1 to 5, a plurality of b's may be the same as or different from one another in a case in which a in Formula (B-2) is 2 or greater.

(B-3)

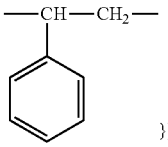

}]

Specific examples of the compound represented by General Formula (B-1) above may include an octyl alcohol AO (11 to 200) adduct, a decyl alcohol AO (11 to 200) adduct, a lauryl alcohol AO (11 to 200) adduct, a myristyl alcohol AO (11 to 200) adduct, a cetyl alcohol AO (11 to 200) adduct, a stearyl alcohol AO (11 to 200) adduct, an isostearyl alcohol AO (11 to 200) adduct, an oleyl alcohol AO (11 to 200) adduct, a behenyl alcohol AO (11 to 200) adduct, a tridecyl alcohol AO (11 to 200) adduct, a 2-butyloctanol AO (11 to 200) adduct, a 2-butyldecanol AO (11 to 200) adduct, a 2-hexyloctanol AO (11 to 200) adduct, a 2-hexyldecanol AO (11 to 200) adduct, a 2-octyldodecanol AO (11 to 200) adduct, a 2-hexyldodecanol AO (11 to 200) adduct, a 2-octyldodecanol AO (11 to 200) adduct, a 2-decyltetradecanol AO (11 to 200) adduct, a 2-dodecylhexadecanol AO (11 to 200) adduct, a 2-tetradecyloctadecanol AO (11 to 200) adduct, an isooctanol AO (11 to 200) adduct, a 2-ethylhexanol AO (11 to 200) adduct, an isononanol AO (11 to 200) adduct, an isodecanol AO (11 to 200) adduct, an isoundecanol AO (11 to 200) adduct, an isotridecanol AO (11 to 200) adduct, an octane-2-ol AO (11 to 200) adduct, a 2-dodecanol AO (11 to 200) adduct, a monostyrenated phenol AO (11 to 200) adduct, a distyrenated phenol AO (11 to 200) adduct, a tristyrenated phenol AO (11 to 200) adduct, a hydroxystearyl alcohol AO (11 to 200) adduct, a caprylic acid AO (11 to 200) adduct, a capric acid AO (11 to 200) adduct, a lauric acid AO (11 to 200) adduct, a myristic acid AO (11 to 200) adduct, a palmitic acid AO (11 to 200) adduct, a stearic acid AO (11 to 200) adduct, an oleic acid AO (11 to 200) adduct, a polyoxyalkylene (11 to 200) dicaprylic acid, a polyoxyalkylene (11 to 200) dipalmitic acid, a polyoxyalkylene (11 to 200) dioleic acid, a polyoxyalkylene (11 to 200)

distearic acid, octyl ester of an octyl alcohol AO (11 to 200) adduct (namely, a polyoxyalkylene (11 to 200) octyl ether octyl ester), decyl ester of a decyl alcohol AO (11-200) adduct (namely, a polyoxyalkylene (11 to 200) decyl ether decyl ester), lauryl ester of a lauryl alcohol AO (11 to 200) adduct (namely, a polyoxyalkylene (11 to 200) lauryl ether lauryl ester), octyl ester of a myristyl alcohol AO (11 to 200) adduct (namely, a polyoxyalkylene (11 to 200) myristyl ether octyl ester), octyl ester of a cetyl alcohol AO (11 to 200) adduct (namely, a polyoxyalkylene (11 to 200) cetyl ether octyl ester), methyl ether of an octyl alcohol AO (11 to 200) adduct (namely, a polyoxyalkylene (11 to 200) octyl ether methyl ether), ethyl ether of an octyl alcohol AO (11 to 200) adduct (namely, a polyoxyalkylene (11 to 200) octyl ether ethyl ether), methyl ether of a decyl alcohol AO (11 to 200) adduct (namely, a polyoxyalkylene (11 to 200) decyl ether methyl ether), methyl ether of a lauryl alcohol AO (11 to 200) adduct (namely, a polyoxyalkylene (11 to 200) lauryl ether methyl ether), ethyl ether of a lauryl alcohol AO (11 to 200) adduct (namely, a polyoxyalkylene (11 to 200) lauryl ether ethyl ether), methyl ether of a myristyl alcohol AO (11 to 200) adduct (namely, a polyoxyalkylene (11 to 200) myristyl ether methyl ether), methyl ether of a cetyl alcohol AO (11 to 200) adduct (namely, a polyoxyalkylene (11 to 200) cetyl ether methyl ether), and methyl ether of a stearyl alcohol AO (11 to 200) adduct (namely, a polyoxyalkylene (11 to 200) stearyl ether methyl ether). The numerical values in parentheses indicate the molar number.

The alkyleneoxy groups of AO described above may be the same as or different from one another, and they may be blockwisely, randomly, or alternately added in the case of being different from one another.

In the compound represented by General Formula (B-1) above, $R^1$ is preferably an alkyl group having from 8 to 30 carbon atoms or an alkenyl group having from 8 to 30 carbon atoms and more preferably an alkyl group having from 12 to 24 carbon atoms or an alkenyl group having from 12 to 24 carbon atoms from the viewpoint of cleaning performance and defoaming property.

In addition, in the compound represented by General Formula (B-1) above, it is preferable that AO is formed by random addition of an oxyethylene group and an oxypropylene group, the blended ratio (mass ratio) of the oxyethylene group to the oxypropylene group is oxyethylene group:oxypropylene group=20:80 to 80:20, and y is from 11 to 100 and it is more preferable that AO is formed by random addition of an oxyethylene group and an oxypropylene group, the blended ratio (mass ratio) of the oxyethylene group to the oxypropylene group is oxyethylene group: oxypropylene group=20:80 to 80:20, and y is from 11 to 80 from the viewpoint of cleaning performance and defoaming property.

The compound represented by General Formula (B-1) above is preferably a compound represented by General Formula (B-1) above in which $R^1$ is an alkyl group having from 8 to 30 carbon atoms or an alkenyl group having from 8 to 30 carbon atoms, $R^2$ is a hydrogen atom, x and z are 0, AO is formed by random addition of an oxyethylene group and an oxypropylene group, the blended ratio (mass ratio) of the oxyethylene group to the oxypropylene group is oxyethylene group:oxypropylene group=20:80 to 80:20, and y is from 11 to 100 from the viewpoint of cleaning performance and defoaming property.

In addition, a compound represented by General Formula (B-1) above in which $R^1$ is an alkyl group having from 12 to 24 carbon atoms or an alkenyl group having from 12 to 24 carbon atoms, $R^2$ is a hydrogen atom, x and z are 0, AO is formed by random addition of an oxyethylene group and an oxypropylene group, the blended ratio (mass ratio) of the oxyethylene group to the oxypropylene group is oxyethylene group:oxypropylene group=20:80 to 80:20, and y is from 11 to 80 is more preferable from the viewpoint of cleaning performance and defoaming property.

The compounds represented by General Formula (B-1) above may be used singly or in combination of two or more kinds thereof.

The amount of the component (B) blended in the cleaning agent composition for hard surface is appropriately set depending on the purpose of use, but it is preferably from 0.01% by mass to 0.5% by mass and more preferably from 0.01% by mass to 0.3% by mass based on the entire amount of the cleaning agent composition for hard surface from the viewpoint of cleaning performance, defoaming property, and economic efficiency.

Next, the specific second alkyleneoxy group-containing compound (C) according to the present embodiment will be described. Examples of the compound may include a compound represented by the following General Formula (C).

$$R^4—O—(AO)_p—H \quad (C)$$

[In Formula (C), $R^4$ represents an alkyl group having from 1 to 8 carbon atoms or an alkenyl group having from 2 to 8 carbon atoms, AO represents an alkyleneoxy group having from 2 to 4 carbon atoms, p represents an average molar number of the alkyleneoxy group added and is in a range of from 1 to 5.]

Specific examples of the compound represented by the General Formula (C) above may include an ethyl alcohol AO (1 to 5) adduct, an isopropyl alcohol AO (1 to 5) adduct, a butyl alcohol AO (1 to 5) adduct, a hexyl alcohol AO (1 to 5) adduct, an octyl alcohol AO (1 to 5) adduct, a 2-ethylhexanol AO (1 to 5) adduct, and a 2-octanol AO (1 to 5) adduct. The numerical values in the parentheses indicate the molar number.

The alkyleneoxy groups of AO described above may be the same as or different from one another, and they may be blockwisely, randomly, or alternately added in the case of being different from one another.

From the viewpoint of defoaming property, in the compound represented by General Formula (C) above, it is preferable that p is from 1 to 5 in a case in which $R^4$ is an alkyl group having from 1 to 4 carbon atoms or an alkenyl group having from 2 to 4 carbon atoms, p is from 1 to 4 in a case in which $R^4$ is an alkyl group having 5 carbon atoms or an alkenyl group having 5 carbon atoms, p is from 1 to 3 in a case in which $R^4$ is an alkyl group having 6 carbon atoms or an alkenyl group having 6 carbon atoms, p is from 1 to 2 in a case in which $R^4$ is an alkyl group having 7 carbon atoms or an alkenyl group having 7 carbon atoms, and p is 1 in a case in which $R^4$ is an alkyl group having 8 carbon atoms or an alkenyl group having 8 carbon atoms in General Formula (C) above.

Specific examples of the compound satisfying the above conditions may include an ethyl alcohol AO (1 to 5) adduct, an isopropyl alcohol AO (1 to 5) adduct, a butyl alcohol AO (1 to 5) adduct, a hexyl alcohol AO (1 to 5) adduct, an octyl alcohol AO (1 to 5) adduct, a 2-ethylhexanol AO (1 to 5) adduct, and a 2-octanol AO (1 to 5) adduct. The numerical values in the parentheses indicate the molar number. Among these, a butyl alcohol EO (1 to 5) adduct, a hexyl alcohol EO (1 to 3) adduct, and a 2-ethylhexanol EO (1) adduct are preferable from the viewpoint of foam inhibiting property.

The compounds represented by General Formula (C) above may be used singly or in combination of two or more kinds thereof.

The amount of the component (C) blended in the cleaning agent composition for hard surface is appropriately set depending on the purpose of use, but it is preferably from 0.1% by mass to 15% by mass and more preferably from 0.1% by mass to 10% by mass based on the entire amount of the cleaning agent composition for hard surface from the viewpoint of cleaning performance, foam inhibiting property, and economic efficiency.

Next, the specific second oxypropylene group-containing compound (D) according to the present embodiment will be described. Examples of the compound may include a compound represented by the following General Formula (D).

$$HO\text{-}(EO)_s\text{-}(PO)_t\text{-}(EO)_u\text{—}H \quad (D)$$

[In Formula (D), EO represents an oxyethylene group, PO represents an oxypropylene group, s and u represent an average molar number of the oxyethylene group added, s+u is in a range of from 0 to 10, and t represents an average molar number of the oxypropylene group added and is in a range of from 1 to 100.]

Specific examples of the compound represented by General Formula (D) above may include $HO\text{—}(PO)_{17}\text{—}H$, $HO\text{—}(PO)_{34}\text{—}H$, $HO\text{-}(EO)_1\text{—}(PO)_{16}\text{-}(EO)_1\text{—}H$, and $HO\text{-}(EO)_{15}\text{—}(PO)_{29}\text{-}(EO)_{15}\text{—}H$.

In the compound represented by General Formula (D) above, it is preferable that t is from 1 to 60 and s+u is from 0 to 10 or t is from 61 to 100 and s+u is from 0 to 5, it is more preferable that t is from 1 to 60 and s+u is from 0 to 10, and it is particularly preferable that t is from 20 to 60 and s+u is from 0 to 10 or t is from 10 to 20 and s+u is 0 in General Formula (D) above from the viewpoint of defoaming property.

The compound represented by General Formula (D) above may be used singly or in combination of two or more kinds thereof.

The amount of the component (D) blended in the cleaning agent composition for hard surface is appropriately set depending on the purpose of use, but it is preferably from 0.01% by mass to 5% by mass, more preferably from 0.05% by mass to 5% by mass, and still more preferably from 0.1% by mass to 3% by mass based on the entire amount of the cleaning agent composition for hard surface from the viewpoint of cleaning performance, defoaming property, and economic efficiency.

In the cleaning agent composition for hard surface of the present embodiment, the mass ratio among the component (A), the component (B), the component (C), and the component (D) is preferably (A):(B):(C):(D)=30 to 94.45:0.05 to 5:5 to 60:0.5 to 20 from the viewpoint of defoaming property.

It is possible to blend a rust-preventive agent, a defoaming agent, a preservative, a surfactant, a chelating agent, an antioxidant, a coloring agent, a deodorant, a perfuming agent, and the like in the cleaning agent composition for hard surface of the present embodiment in a range in which the effect of the present invention is not impaired.

Examples of the rust-preventive agent may include a dicarboxylic acid, and specific examples thereof may include oxalic acid, malonic acid, succinic acid, glutaric acid, adipic acid, fumaric acid, maleic acid, dodecanedioic acid, eicosadioic acid, isodocosadienoic diacid, isodocosanedioic acid, isoeicosadienoic diacid, butyloctanedioic acid, and dialkoxycarbonylisodocosadienoic diacid. These rust-preventive agents may be used singly or in combination of two or more kinds thereof. Incidentally, it is preferable to blend the rust-preventive agent so as not to exceed the preferred amount of the component (A) blended in the case of using a dicarboxylic acid.

Examples of the preservative may include an aromatic carboxylic acid, and specific examples thereof may include benzoic acid, p-toluic acid, p-ethylbenzoic acid, p-isopropylbenzoic acid, p-tert-butylbenzoic acid, xylylic acid, isophthalic acid, terephthalic acid, salicylic acid, cinnamic acid, toluic acid, hemimellitic acid, trimellitic acid, trimesic acid, hydroxybenzoic acid, dihydroxybenzoic acid, and trihydroxybenzoic acid. These preservatives may be used singly or in combination of two or more kinds thereof. Incidentally, it is preferable to blend the preservative so as not to exceed the preferred amount of the component (A) blended in a case in which the aromatic carboxylic acid overlaps with the component (A).

Examples of the surfactant may include a nonionic surfactant such as a higher alcohol alkylene oxide adduct, an alkylphenol alkylene oxide adduct, a fatty acid alkylene oxide adduct, a polyhydric alcohol fatty acid ester alkylene oxide adduct, or a higher alkylamine alkylene oxide adduct, an anionic surfactant such as soap, an alkyl benzene sulfonate salt, a higher alcohol sulfate ester salt, or a polyoxyethylene alkyl ether sulfate salt, and an amphoteric surfactant such as an alkyl amino fatty acid salt or an alkyl betaine. These surfactants may be used singly or in combination of two or more kinds thereof. Incidentally, it is preferable to blend the surfactant so as not to exceed the preferred amount of the component (B) blended or the preferred amount of the component (C) blended in a case in which the higher alcohol alkylene oxide adduct, the alkylphenol alkylene oxide adduct, or the like overlaps with the component (B) or the component (C).

Examples of the chelating agent may include an aminocarboxylic acid-based chelating agent such as EDTA, NTA, DTPA, HEDTA, or TTHA; and a phosphonic acid-based chelating agent such as HEDP or NTMP. These chelating agents may be used singly or in combination of two or more kinds thereof. Incidentally, it is preferable to blend the chelating agent so as not to exceed the preferred amount of the component (A) blended in a case in which the aminocarboxylic acid-based chelating agent overlaps with the component (A).

The pH of the cleaning agent composition for hard surface of the present embodiment is preferably from 5.0 to 14.0, more preferably from 8.0 to 12.0, and particularly preferably from 8.0 to 11.0 from the viewpoint of cleaning performance and rust preventing property. The pH can be adjusted with an alkali such as sodium hydroxide, potassium hydroxide, sodium carbonate, potassium carbonate, or triethanolamine in a case in which the pH is lower than 5.0. The pH can be adjusted with an acid such as hydrochloric acid, sulfuric acid, lactic acid, formic acid, or citric acid in a case in which the pH exceeds 14.0. These pH adjusting agents may be used singly or in combination of two or more kinds thereof. The pH of the cleaning agent composition for hard surface can be measured by a known method such as a glass electrode method.

The static surface tension and dynamic surface tension of the cleaning agent composition for hard surface of the present embodiment are preferably from 20 to 60 mN/m and more preferably 20 to 50 mN/m from the viewpoint of cleaning performance and drying property. The static surface tension can be measured by the Wilhelmy method, and the dynamic surface tension can be measured by the maximum bubble pressure method.

The hard surface of the target to be cleaned with the cleaning agent composition for hard surface of the present embodiment is not particularly limited as long as it has a hard surface, but examples thereof may include a metal such as iron, aluminum, gold, silver, copper, lead, or titanium; glass such as quartz glass, soda glass, potassium glass, borosilicate glass, or lead glass; an alloy such as a stainless steel and a duralumin and titanium alloy; a plated metal such as brass or zinc-coated steel; a plastic such as polyethylene terephthalate, polyethylene, vinyl chloride, polypropylene, polycarbonate, or polyamide; a ceramic; a mineral such as marble or diamond.

The cleaning agent composition for hard surface of the present embodiment may be used as it is, but a treatment liquid prepared by diluting the composition with water may be used. With regard to the concentration of the treatment liquid, the content of the cleaning agent composition for hard surface is preferably from 0.01% by mass to 50% by mass, more preferably from 0.05% by mass to 30% by mass, and still more preferably from 0.1% by mass to 15% by mass based on the entire amount of the treatment liquid from the viewpoint of cleaning performance and economic efficiency.

It is possible to suitably use tap water, well water, ion exchanged water, or distilled water as the water in the present embodiment.

The pH of the treatment liquid prepared by diluting the cleaning agent composition for hard surface with water is preferably from 5.0 to 14.0, more preferably from 8.0 to 12.0, and still more preferably from 8.0 to 11.0 from the viewpoint of cleaning performance and rust preventing property. The pH can be adjusted with an alkali such as sodium hydroxide, potassium hydroxide, sodium carbonate, potassium carbonate, or triethanolamine in a case in which the pH is lower than 5.0. The pH can be adjusted with an acid such as hydrochloric acid, sulfuric acid, lactic acid, formic acid, or citric acid in a case in which the pH exceeds 14.0. These pH adjusting agents may be used singly or in combination of two or more kinds thereof. The pH of the treatment liquid can be measured by a known method such as a glass electrode method.

The static surface tension and dynamic surface tension of the treatment liquid prepared by diluting the cleaning agent composition for hard surface with water are preferably from 20 to 60 mN/m and more preferably 20 to 50 mN/m from the viewpoint of cleaning performance and drying property. The static surface tension of the treatment liquid can be measured by the Wilhelmy method, and the dynamic surface tension thereof can be measured by the maximum bubble pressure method.

The cleaning method using the cleaning agent composition for hard surface of the present embodiment is not particularly limited, but the cleaning agent composition for hard surface is suitably used in a cleaning method which additionally includes a physical operation, such as an ultrasonic method, a spraying method, a bubbling method, a barrelling method, or a dipping and shaking method.

The cleaning temperature is preferably from 5° C. to 100° C., more preferably from 10° C. to 80° C., and particularly preferably from 15° C. to 80° C. from the viewpoint of cleaning performance and economic efficiency. The cleaning time can be appropriately set depending on the shape and size of the material to be cleaned, the cleaning method, and the cleaning condition.

EXAMPLES

Hereinafter, the present invention will be described in more detail with reference to Examples, but the present invention is not limited by these Examples at all.

Examples 1 to 15 and Comparative Examples 1 to 7

The cleaning agent compositions for hard surface of Examples 1 to 15 and Comparative Examples 1 to 7 were prepared in accordance with the components and compositions (% by mass) presented in Tables 1 to 4. Specifically, the component (A) and the component (E) were added to the ion exchanged water (F), they were mixed together until to be uniform, the component (B), the component (C), and component (D) were further added to the mixture, and they were mixed together to prepare the cleaning agent compositions for hard surface. Cleaning agents for hard surface were prepared by diluting the cleaning agent compositions for hard surface of Examples 1 to 15 and Comparative Examples 1 to 7 thus obtained with ion exchanged water to have a concentration of 3% by mass and subjected to the following tests for evaluation.

[Test for Evaluation on Cleaning Performance]

A commercially available cold-rolled steel sheet which had been cut into 50 mm×50 mm×1 mm was used as a test piece. The surface of the test piece was cleaned with n-hexane, and coated with 0.2 g of rust-preventive oil (ANTIRUST P2800 manufactured by JXTG Nippon Oil & Energy Corporation) as a contaminant to prepare a contaminated sample.

For cleaning, each of the cleaning agents for hard surface of Examples 1 to 15 and Comparative Examples 1 to 7 was filled in an ultrasonic cleaning machine (BRANDONIC B2200 manufactured by Emerson Japan, Ltd.), the temperature of the cleaning agent for hard surface was adjusted to 25° C. or 60° C., and the contaminated sample was then dipped in the cleaning agent for hard surface and subjected to ultrasonication for 2 minutes. Thereafter, the test piece was pulled up therefrom and dried at 80° C. for 30 minutes. The cleaning rate was calculated by the following equation.

Cleaning rate (% by mass)=[{weight of contaminated sample before being cleaned(g)}−{weight of contaminated sample after being cleaned(g)}]×100/[{weight of contaminated sample before being cleaned(g)}−{weight of test piece(g)}]

[Test for Evaluation on Foam Inhibiting Property and Defoaming Property]

The amount of foam (mL) on the liquid surface was measured immediately and in 1 minute after 50 ml of each of the cleaning agents for hard surface of Examples 1 to 15 and Comparative Examples 1 to 7 adjusted to a predetermined temperature (25° C. or 60° C.) was poured into a 100 ml Nessler tube and the Nessler tube was swung up and down ten times for 5 seconds with an amplitude width of 20 cm and left on a horizontal table to stand still.

Incidentally, the following compounds were used as the polycarboxylic acid Na*1, polycarboxylic acid Na*2, polyalkylene glycol 1*3, polyalkylene glycol 2*4, polyalkylene glycol 3*5, polyalkylene glycol 4*6, polyalkylene glycol 5*7, polyalkylene glycol 6*8, polyalkylene glycol 7*9 in Tables 1 to 4.

*1: Sodium polyacrylate (weight average molecular weight: 6,000)

*2: Sodium polyacrylate (weight average molecular weight: 20,000)

*3: Polyalkylene glycol (a compound represented by General Formula (D) above in which s+u is 0 and t is 17, number average molecular weight: 1000, PO content: 100% by mass, and active component: 100% by mass)

*4: Polyalkylene glycol (a compound represented by General Formula (D) above in which s+u is 0 and t is 34, number average molecular weight: 2000, PO content: 100% by mass, and active component: 100%)

*5: Polyalkylene glycol (a compound represented by General Formula (D) above in which s+u is 0 and t is 52, number average molecular weight: 3000, PO content: 100% by mass, and active component: 100% by mass)

*6: Polyalkylene glycol (a compound represented by General Formula (D) above in which s+u is 2 and t is 17, number average molecular weight: 1100, PO content: 90% by mass, EO content: 10% by mass, and active component: 100% by mass)

*7: Polyalkylene glycol (a compound represented by General Formula (D) above in which s+u is 3.5 and t is 32, number average molecular weight: 2000, PO content: 90% by mass, EO content: 10% by mass, and active component: 100% by mass)

*8: Polyalkylene glycol (a compound represented by General Formula (D) above in which s+u is 8 and t is 32, number average molecular weight: 2,200, PO content: 80% by mass, EO content: 20% by mass, and active component: 100% by mass)

*9: Polyalkylene glycol (a compound represented by General Formula (D) above in which s+u is 16.3 and t is 65.2, number average molecular weight: 4,500, PO content: 80% by mass, EO content: 20%, and active component: 100% by mass)

In addition, the polyoxyethylene (18.2) polyoxypropylene (43.6) stearyl ether is a compound represented by General Formula (B-1) above in which $R^1$ is an alkyl group having 18 carbon atoms, $R^2$ is a hydrogen atom, x and z are 0, and $(AO)_y$ is a polyoxyethylene group added in an average molar number of 18.2 and a polyoxypropylene group added in an average molar number of 43.6, and the polyoxypropylene (34) distearic acid is a compound represented by General Formula (B-1) above in which $R^1$ and $R^2$ are an alkyl group having 18 carbon atoms, x and y are 1, and $(AO)_y$ is a polyoxypropylene group added in an average molar number of 34.

TABLE 1

| | | Example 1 | Example 2 | Example 3 | Example 4 | Example 5 |
|---|---|---|---|---|---|---|
| Component (A) | Caprylic acid | 8 | 8 | 8 | 8 | 8 |
| | Polycarboxylic acid Na*1 | 1 | | 1 | 1 | 1 |
| | Polycarboxylic acid Na*2 | | 1 | | | |
| Component (B) | Polyoxyethylene (18.2) polyoxypropylene (43.6) stearyl ether | 0.06 | 0.06 | 0.06 | | 0.06 |
| | Polyoxypropylene (34) distearic acid | | | | 0.06 | |
| Component (C) | Butyl diglycol | 4 | 4 | | 4 | 4 |
| | 2-ethylhexyl glycol | | | 4 | | |
| Component (D) | Polyalkylene glycol 1*3 | 0.6 | 0.6 | 0.6 | 0.6 | |
| | Polyalkylene glycol 2*4 | | | | | 0.6 |
| Component (E) | Triethanolamine | 25 | 25 | 25 | 25 | 25 |
| Component (F) | Ion exchanged water | Remainder | Remainder | Remainder | Remainder | Remainder |
| Sum | | 100 | 100 | 100 | 100 | 100 |
| pH of cleaning agent composition for hard surface | | 8.6 | 8.6 | 8.6 | 8.6 | 8.6 |
| (A):(B):(C):(D) | | 65.9:0.4: 29.3:4.4 | 65.9:0.4: 29.3:4.4 | 65.9:0.4: 29.3:4.4 | 65.9:0.4: 29.3:4.4 | 65.9:0.4: 29.3:4.4 |
| Amount of foam (immediately after leaving cleaning agent for hard surface to stand still) (ml) | 60° C. | 5 | 5 | 5 | 5 | 5 |
| | 25° C. | 5 | 5 | 5 | 6 | 5 |
| Amount of foam (in 1 minute after leaving cleaning agent for hard surface to stand still) (ml) | 60° C. | 1 | 1 | 1 | 1 | 1 |
| | 25° C. | 1 | 1 | 1 | 2 | 1 |
| Cleaning rate (% by mass) | 60° C. | 80 | 80 | 79 | 79 | 80 |
| | 25° C. | 64 | 63 | 64 | 63 | 65 |

TABLE 2

| | | Example 6 | Example 7 | Example 8 | Example 9 | Example 10 |
|---|---|---|---|---|---|---|
| Component (A) | Caprylic acid | 8 | 8 | 8 | 8 | 8 |
| | Polycarboxylic acid Na*1 | 1 | 1 | 1 | 1 | 1 |
| | Polycarboxylic acid Na*2 | | | | | |
| Component (B) | Polyoxyethylene (18.2) polyoxypropylene (43.6) stearyl ether | 0.06 | 0.06 | 0.06 | 0.06 | 0.02 |
| | Polyoxypropylene (34) distearic acid | | | | | |
| Component (C) | Butyl diglycol | 4 | 4 | 4 | 4 | 4 |
| | 2-ethylhexyl glycol | | | | | |
| Component (D) | Polyalkylene glycol 1*3 | | | | | 0.6 |
| | Polyalkylene glycol 2*4 | | | | | |
| | Polyalkylene glycol 3*5 | 0.6 | | | | |
| | Polyalkylene glycol 4*6 | | 0.6 | | | |

TABLE 2-continued

| | | Example 6 | Example 7 | Example 8 | Example 9 | Example 10 |
|---|---|---|---|---|---|---|
| | Polyalkylene glycol 5*7 | | | 0.6 | | |
| | Polyalkylene glycol 6*8 | | | | 0.6 | |
| Component (E) | Triethanolamine | 25 | 25 | 25 | 25 | 25 |
| Component (F) | Ion exchanged water | Remainder | Remainder | Remainder | Remainder | Remainder |
| Sum | | 100 | 100 | 100 | 100 | 100 |
| pH of cleaning agent composition for hard surface | | 8.6 | 8.6 | 8.6 | 8.6 | 8.6 |
| (A):(B):(C):(D) | | 65.9:0.4: 29.3:4.4 | 65.9:0.4: 29.3:4.4 | 65.9:0.4: 29.3:4.4 | 65.9:0.4: 29.3:4.4 | 66.1:0.1: 29.4:4.4 |
| Amount of foam (immediately after leaving cleaning agent for hard surface to stand still) (ml) | 60° C. | 5 | 7 | 5 | 5 | 7 |
| | 25° C. | 5 | 8 | 5 | 5 | 8 |
| Amount of foam (in 1 minute after leaving cleaning agent for hard surface to stand still) (ml) | 60° C. | 1 | 3 | 1 | 1 | 3 |
| | 25° C. | 1 | 4 | 1 | 1 | 4 |
| Cleaning rate (% by mass) | 60° C. | 80 | 79 | 81 | 80 | 78 |
| | 25° C. | 64 | 64 | 64 | 63 | 62 |

20

TABLE 3

| | | Example 11 | Example 12 | Example 13 | Example 14 | Example 15 |
|---|---|---|---|---|---|---|
| Component (A) | Caprylic acid | 8 | 8 | 8 | 8 | 8 |
| | Polycarboxylic acid Na*1 | 1 | 1 | 1 | 1 | 1 |
| | Polycarboxylic acid Na*2 | | | | | |
| Component (B) | Polyoxyethylene (18.2) polyoxypropylene (43.6) stearyl ether | 0.4 | 0.06 | 0.06 | 0.06 | 0.06 |
| | Polyoxypropylene (34) distearic acid | | | | | |
| Component (C) | Butyl diglycol | 4 | 1 | 9 | 4 | 4 |
| | 2-ethylhexyl glycol | | | | | |
| Component (D) | Polyalkylene glycol 1*3 | 0.6 | 0.6 | 0.6 | 0.2 | 2 |
| Component (E) | Triethanolamine | 25 | 25 | 25 | 25 | 25 |
| Component (F) | Ion exchanged water | Remainder | Remainder | Remainder | Remainder | Remainder |
| Sum | | 100 | 100 | 100 | 100 | 100 |
| pH of cleaning agent composition for hard surface | | 8.6 | 8.6 | 8.6 | 8.6 | 8.6 |
| (A):(B):(C):(D) | | 64.3:2.9: 28.6:4.3 | 84.4:0.6: 9.4:5.6 | 48.2:0.3: 48.2:3.2 | 67.9:0.5: 30.2:1.5 | 59.8:0.4: 26.6:13.3 |
| Amount of foam (immediately after leaving cleaning agent for hard surface to stand still) (ml) | 60° C. | 4 | 8 | 3 | 7 | 4 |
| | 25° C. | 5 | 9 | 4 | 8 | 5 |
| Amount of foam (in 1 minute after leaving cleaning agent for hard surface to stand still) (ml) | 60° C. | 1 | 3 | 1 | 3 | 1 |
| | 25° C. | 1 | 4 | 1 | 4 | 1 |
| Cleaning rate (% by mass) | 60° C. | 81 | 77 | 82 | 78 | 81 |
| | 25° C. | 64 | 62 | 65 | 62 | 64 |

TABLE 4

| | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|
| Component (A) | Caprylic acid | 8 | | 8 | 8 | 8 | 8 | 8 |
| | Polycarboxylic acid Na*1 | 1 | | 1 | 1 | 1 | 1 | 1 |
| Component (B) | Polyoxyethylene (18.2) polyoxypropylene (43.6) stearyl ether | 0.06 | 0.06 | | 0.06 | | 0.06 | 0.06 |
| | Polyoxyethylene (18.2) polyoxypropylene (43.6) dibutyl ether | | | | | 0.06 | | |
| Component (C) | Butyl diglycol | 4 | 4 | 4 | | 4 | 4 | |
| | 2-ethylhexanol (EO 10) adduct | | | | | | | 4 |
| Component (D) | Polyalkylene glycol 1*3 | | 0.6 | 0.6 | 0.6 | 0.6 | | 0.6 |
| | Polyalkylene glycol 7*9 | | | | | | 0.6 | |

TABLE 4-continued

| | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|
| Component (E) | Triethanolamine | 25 | 25 | 25 | 25 | 25 | 25 | 25 |
| Component (F) | Ion exchanged water | Remainder | Remainder | Remainder | Remainder | Remainder | Remainder | Remainder |
| Sum | | 100 | 100 | 100 | 100 | 100 | 100 | 100 |
| pH of cleaning agent composition for hard surface | | 8.6 | 8.6 | 8.6 | 8.6 | 8.6 | 8.6 | 8.6 |
| (A):(B):(C):(D) | | 68.9:0.5:30.6:0 | 0:1.3:85.8:12.9 | 66.2:0:29.4:4.4 | 93.2:0.6:0:6.2 | 66.2:0:29.4:4.4 | 68.9:0.5:30.6:0 | 93.2:0.6:0:6.2 |
| Amount of foam (immediately after leaving cleaning agent for hard surface to stand still) (ml) | 60° C. | 5 | 5 | 12 | 5 | 10 | 5 | 5 |
| | 25° C. | 14 | 5 | 15 | 14 | 12 | 15 | 15 |
| Amount of foam (in 1 minute after leaving cleaning agent for hard surface to stand still) (ml) | 60° C. | 1 | 1 | 8 | 1 | 5 | 1 | 1 |
| | 25° C. | 12 | 1 | 8 | 10 | 6 | 11 | 10 |
| Cleaning rate (% by mass) | 60° C. | 77 | 50 | 75 | 76 | 76 | 77 | 76 |
| | 25° C. | 47 | 29 | 47 | 37 | 62 | 57 | 57 |

As presented in Tables 1 to 4, it has been confirmed that the cleaning agent compositions of Examples 1 to 15 exhibit excellent cleaning performance, foam inhibiting property, and defoaming property under any cleaning condition of 25° C. or 60° C.

INDUSTRIAL APPLICABILITY

According to the present invention, it is possible to provide a cleaning agent composition which can obtain sufficient detergency while sufficiently suppressing the generation of bubbles even at room temperature. This makes it possible to expect energy cost saving as the cleaning step which has been hitherto performed at a high temperature is performed at normal temperature and the cleaning bath is thus not required to be heated.

The invention claimed is:

1. A cleaning agent composition for hard surface comprising:

(A) at least one kind of carboxylic acid compound selected from the group consisting of an aliphatic monocarboxylic acid, a polycarboxylic acid, and any neutralized salt of these;

(B) a compound represented by the following General Formula (B-1);

(C) a compound represented by the following General Formula (C); and (D) a compound represented by the following General Formula (D)

(B-1)

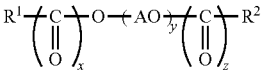

[in Formula (B-1), $R^1$ represents an alkyl group which has from 8 to 30 carbon atoms and may have a hydroxyl group, an alkenyl group which has from 8 to 30 carbon atoms and may have a hydroxyl group, or a group represented by the following General Formula (B-2), $R^2$ represents a hydrogen atom, an alkyl group which has from 1 to 30 carbon atoms and may have a hydroxyl group, or an alkenyl group which has from 2 to 30 carbon atoms and may have a hydroxyl group, x and z are each independently 0 or 1, AO represents an alkyleneoxy group having from 2 to 4 carbon atoms, and y represents an average molar number of the alkyleneoxy group added and is in a range of from 11 to 200; However, $R^2$ is a hydrogen atom and x and z are 0 when $R^1$ is a group represented by the following General Formula (B-2);

(B-2)

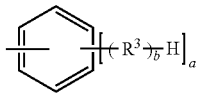

{in Formula (B-2), $R^3$ represents a divalent group represented by the following Formula (B-3), a is an integer from 1 to 5, b is an integer from 1 to 5, a total number of a×b is in a range of from 1 to 5, a plurality of b's may be the same as or different from one another when a in Formula (B-2) is 2 or greater;

(B-3)

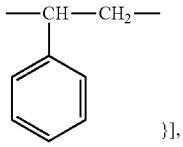

}], (C)

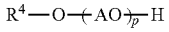

[in Formula (C), $R^4$ represents an alkyl group having from 1 to 8 carbon atoms or an alkenyl group having from 2 to 8 carbon atoms, AO represents an alkyleneoxy group having from 2 to 4 carbon atoms, p represents an average molar number of the alkyleneoxy group added and is in a range of from 1 to 5;], (D)

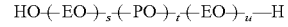

[in Formula (D), EO represents an oxyethylene group, PO represents an oxypropylene group, s and u represent an average molar number of the oxyethylene group added, s+u is in a range of from 0 to 10, and t represents an average molar number of the oxypropylene group added and is in a range of from 1 to 100].

2. The cleaning agent composition for hard surface according to claim 1, wherein a content of the carboxylic acid compound is from 1% by mass to 40% by mass, a content of the compound represented by General Formula (B-1) above is from 0.01% by mass to 0.5% by mass, a content of the compound represented by General Formula (C) above is from 0.1% by mass to 15% by mass, and a content of the compound represented by General Formula (D) above is from 0.01% by mass to 5% by mass based on the entire amount of the cleaning agent composition for hard surface.

* * * * *